United States Patent [19]

Wöber et al.

[11] 4,257,889

[45] Mar. 24, 1981

[54] OIL SKIMMING APPARATUS

[75] Inventors: Wolfram Wöber; Dirk Franzius; Gerd Andersson; Klaus Jung, all of Hamburg; Peter Suess, Buxtehude; Claus Wagner, Henstedt-Ulzburg, all of Fed. Rep. of Germany

[73] Assignee: Blohm & Voss AG, Hamburg, Fed. Rep. of Germany

[21] Appl. No.: 124,753

[22] Filed: Feb. 26, 1980

[30] Foreign Application Priority Data

Mar. 1, 1979 [DE] Fed. Rep. of Germany ..... 2908030

[51] Int. Cl.[3] ..... E02B 15/04

[52] U.S. Cl. ..... 210/104; 210/242.3; 210/923

[58] Field of Search ..... 210/242 S, 96.1, 242 R, 210/104, DIG. 25, 115

[56] References Cited

U.S. PATENT DOCUMENTS

| | | | |
|---|---|---|---|
| 3,909,417 | 9/1975 | Rafael | 210/DIG. 25 |
| 3,928,206 | 12/1975 | Waren | 210/242 S |
| 3,966,615 | 6/1976 | Petchul et al. | 210/DIG. 25 |
| 3,971,719 | 7/1976 | Peters | 210/104 |
| 4,108,773 | 8/1978 | Macaluso | 210/242 S |
| 4,136,030 | 1/1979 | Seike et al. | 210/242 S |
| 4,165,282 | 8/1979 | Bennett et al. | 210/242 S |
| 4,191,650 | 3/1980 | Muneta | 210/DIG. 25 |

*Primary Examiner*—Benoit Castel

*Attorney, Agent, or Firm*—Toren, McGeady and Stanger

[57] ABSTRACT

In a ship an opening is provided in the bow for skimming an oil/water mixture off the surface of the body of the water on which the ship travels. A ramp located within the ship slopes upwardly from the bow toward the stern and conveys the mixture to a location over a collection tank. The end of the ramp closer to the stern is formed by an overflow flap pivotally connected to the fore part of the ramp. Sensing elements check various factors affecting flow into the collecting tank and control an adjusting device which pivotally positions the overflow flap relative to the remainder of the ramp.

5 Claims, 3 Drawing Figures

OIL SKIMMING APPARATUS

SUMMARY OF THE INVENTION

The present invention is directed to an oil skimming apparatus and includes a water craft or ship hving an openable flap or door in its bow with a ramp running in the bow-stern direction upwardly from the bow opening. An oil/water mixture is skimmed off the surface of the body of water by the ramp and flows into a collecting tank serving as an oil separator. The separated oil is stored in tanks on bord the ship and the water is directed back into the body of water.

There is a known apparatus involving a water craft for collecting driftage floating on the surface of a body of water, particularly an oil spread extending over an area of the surface. In this arrangement a ramp is fixed in the water craft and is inclined in the direction of travel of the craft so that it projects from a point above the plane of the water to a point below the plane. The ramp acts as a skimming plate and is followed by a collecting tank which serves as a separating chamber for the oil/water mixture.

This known arrangement is not fully satisfactory because its effectiveness is rather limited. The problem with this arrangement is that the skimming plate, especially in rough water, skims off a mixture which predominantly consists of water. Moreover, the varying draft of the craft contributes to the poor economy of its operation. Therefore, it is the primary object of the present invention to provide an oil skimming apparatus which affords optimum performance independent of the movement of the water craft or ship and also of the wave conditions in the body of water.

In accordance with the present invention, an overflow flap is provided at the aft end of the ramp and it is pivoted to the ramp about an axis extending transversely of the bow-stern direction. The aft end of the overflow flap forms an overflow edge located above the collecting tank. An adjusting device pivots the overflow flap in accordance with the conditions affecting flow over the ramp as determined by sensors or signal transmitters. It can be appreciated from the above description that the oil/water mixture flowing through an opening in the bow over the ramp flows in an advantageous manner over the pivotally adjustable and controllable overflow flap so that, to a significant extent, a separation of the oil/water mixture can be effected before the mixture flows over the overflow edge of the flap into the collecting tank.

In accordance with the invention, certain provisions are made to achieve the desired goal, more particularly, the overflow flap is positioned continuously to afford an exactly dimensioned surface layer containing a minimum amount of water in the layer as it flows into the collecting tank. One feature of the invention involves the use of a first sensor in the form of a float which checks the level of the oil/water mixture adjacent the overflow edge of the flap and corrects the vertical position of the flap.

Another sensor continuously checks the angle of inclination $\alpha$ of the overflow flap so that in combination with the above-mentioned sensor it is possible to correct the vertical position of the flap.

Finally, a third sensor checks the level of the oil/water mixture in the collecting tank and transmits appropriate pulses to the adjusting device for varying the angle of inclination of the overflow flap.

Still another feature of the invention involves the use of successively arranged and transversely extending perforated web plates mounted on and extending for a significant height above the ramp. These plates provide a damping action on the flow of the oil/water mixture and dissipate the wave energy within the mixture.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
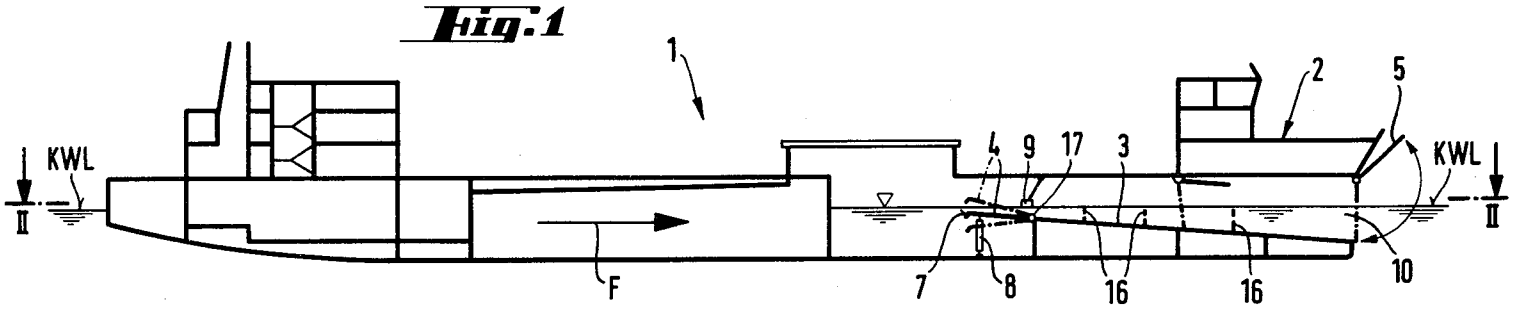
FIG. 1 is a side view of a ship or water craft embodying the present invention.
Figure 2:
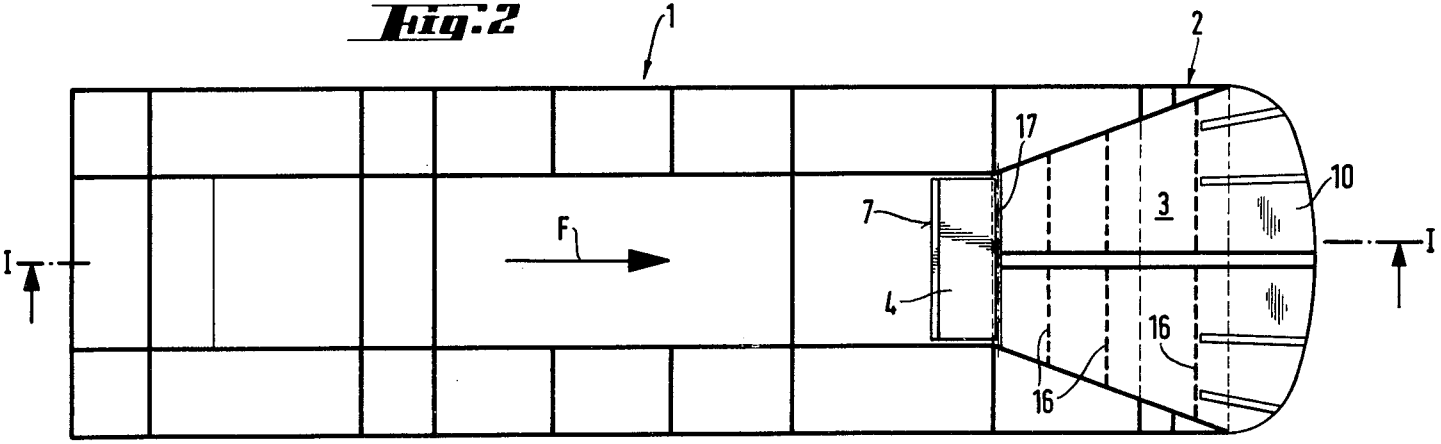
FIG. 2 is a plan view of the ship illustrated in FIG. 1.

In FIGS. 1 and 2 a ship or water craft 1 is shown having a "fat hull" and an inboard propulsion system, not shown. The ship is a seaworthy craft and in its fore portion it has a bow flap 2, not illustrated in detail, which can be swung upwardly to provide an opening in the bow. Accordingly, the bow can be opened or closed as desired.

The opening afforded by the bow flap 2 contains the fore end of a ramp which extends obliquely upward from the opening in the bow-stern direction. The ramp 3, as can be seen in FIG. 1, is basically located below the water line KWL. Any oil/water mixture 13 collected or skimmed from the surface of the body of water in which the ship 1 travels flows over the ramp in the direction of the arrow P, note FIG. 3, with a velocity determined by the propulsion power of the ship and the condition of the body of water.

These two parameters essentially determine the skimming efficiency or effectiveness of the oil skimming apparatus. It must be assured that the oil/water mixture 13 flowing over the ramp 3 is not only quieted as much as possible, but also that its quantity is regulated.

Figure 3:
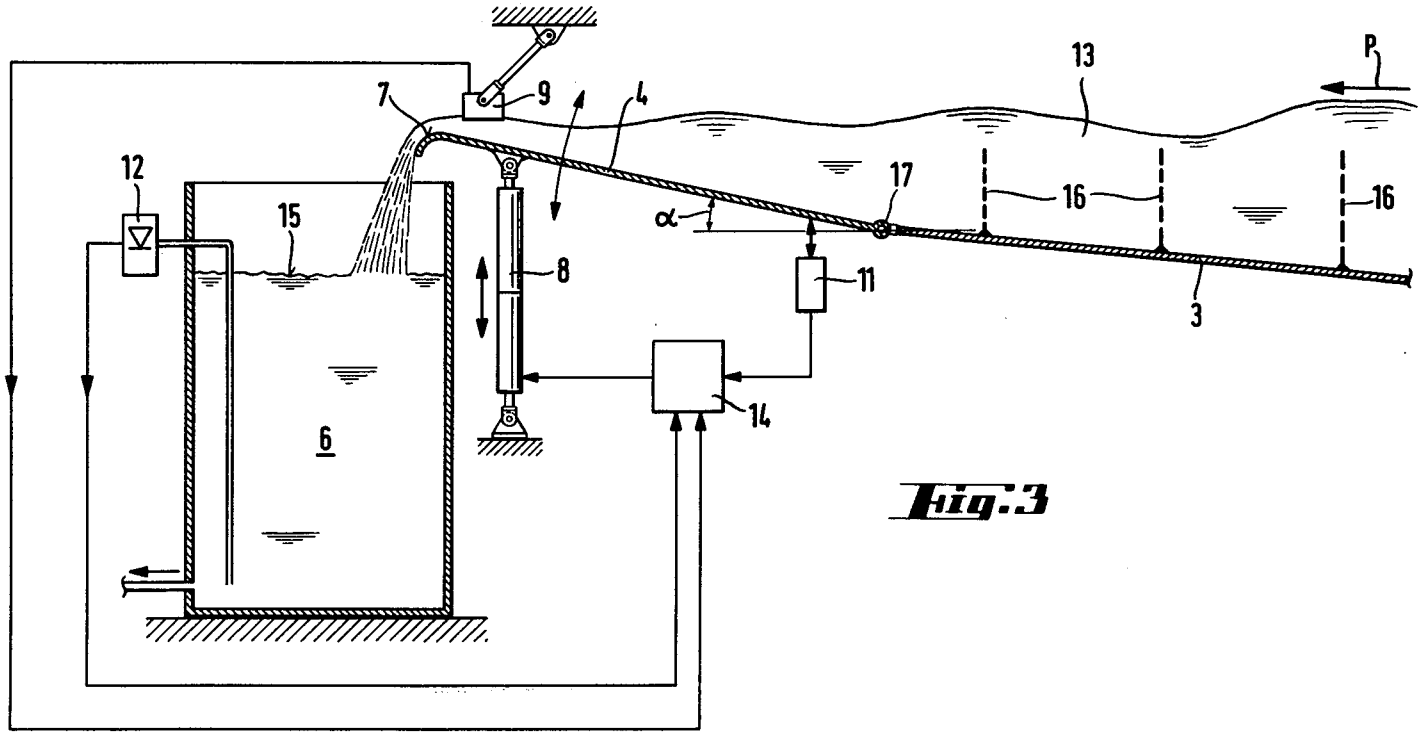
FIG. 3 is an enlarged schematic view of the oil skimming apparatus.

These conditions are met, as shown in FIG. 3, by an overflow flap 4 hinged at 17 to the aft end of the ramp 3 about an axis extending transversely of the bow-stern direction. An adjusting device 8 is located below and connected to the overflow ramp 4 for adjusting the angle of the overflow flap relative to the remainder of the ramp extending forwardly from the pivot axis. Sensors 9, 11 and 12 control the adjusting device 8 and determine the angular relation of the overflow flap to the remainder of the ramp 3 by means of a control box 14. Sensor 9, constructed as a float, continuously monitors the level of the oil/water mixture 13 flowing over the flap 4 adjacent its overflow edge 7. Another sensor 11 continuously measures the angle of inclination 2 of the flap relative to the horizontal and similarly, relative to the fixed part of the ramp 3 extending between the opening and the pivot axis. If necessary, both of the values checked by the sensors 9 and 11 trigger a pulse for operating the adjusting device 8. By an appropriate adjustment of the overflow flap 4, effected by the adjusting device 8, the volume flow of the oil/water mixture passing over the overflow edge 7 is regulated with the flow moving over the edge 7 being directed into a collecting tank 6 having a liquid level 15, which tank acts as an oil separator.

The third one of the sensors 12 which regulates the operation of the adjusting device 8, continuously monitors the level of the oil/water mixture within the collecting tank 6 and, if necessary, adjusts the angle of the inclination $\alpha$ of the overflow flap when, for example, the liquid level in the collecting tank reaches a given height.

It may prove advantageous, particularly at high speeds of the ship or extremely rough water conditions, to afford an additional quieting action on the oil/water mixture flowing in over the ramp, since, otherwise, the desired separation of the oil would be negatively influenced by such conditions. The quieting effect can be provided by dissipating the wave energy in the mixture flowing over the ramp 3. Accordingly, perforated web plates 16 are provided on the ramp. These plates extend transversely of the bow-stern direction and are arranged one after the other along the ramp. Furthermore, the web plates 16 have a significant height above the ramp for achieving the desired quieting effect.

While specific embodiments of the invention have been shown and described in detail to illustrate the application of the inventive principles, it will be understood that the invention may be embodied otherwise without departing from such principles.

What is claimed is:

1. Apparatus for skimming oil from the surface of a body of water comprising a ship having a bow, a stern and a water line, a flap displaceably mounted on the bow of said ship for forming an opening into the interior thereof with the opening extending from above to below the water line, said opening arranged to receive a mixture of oil and water from the surface of the body of water on which said ship travels, a ramp located within said ship and extending from the lower end of the opening in the bow toward the stern with said ramp being inclined upwardly in the direction toward the stern, a collecting tank located within said ship at the end of said ramp closer to the stern, said collecting tank arranged to provide a separation of the mixture of oil and water so that the oil can be stored in the ship and the water can be directed back into the body of the water, wherein the improvement comprises that the end of said ramp closer to the stern comprises an overflow flap extending in the bow-stern direction and having a first end closer to the bow pivotally attached to said ramp about a pivot axis extending transversely of the bow-stern direction and a second end closer to the stern located in the region above said collecting tank, said second end of said ramp forming an overflow edge for the mixture passing over said overflow flap into said collecting tank, an adjusting device mounted in said ship and connected to said overflow flap for pivotally displacing said overflow flap relative to the remainder of said ramp and for vertically positioning said second end relative to said collecting tank, and means connected to said adjusting device for controlling the position of said overflow flap, said controlling means comprising a plurality of sensing elements each arranged to check a factor affecting flow of the mixture over said ramp into said collecting tank, and said plurality of sensing elements comprising a first said sensing element arranged to check the level of flow over said second end of said overflow flap relative to the remainder of said ramp through the medium of said adjusting device.

2. Apparatus, as set forth in claim 1, wherein said first sensing element comprises a float.

3. Apparatus, as set forth in claim 1, including a second said sensing element continuously measuring the angular relation of said overflow flap relative to the remainder of said ramp whereby the combination of said first and second sensing elements acting through said adjusting device adjust the angular position of said overflow flap relative to the remainder of said ramp.

4. Apparatus, as set forth in claim 5, wherein a third said sensing element being arranged to check the level of the oil/water mixture in said collecting tank and being connected to said adjusting device for adjusting the angular position of said overflow flap relative to the remainder of said ramp.

5. Apparatus, as set forth in any one of claims 1, 2, 3 or 4, including a plurality of perforated web plates secured to and extending upwardly from said ramp, said web plates extending transversely of the bow-stern direction and being arranged successively along the bow-stern direction, said web plates having a significant height above said ramp for dissipating the wave energy within the oil/water mixture flowing over said ramp.

* * * * *